US005669057A

United States Patent [19]

Whiting

[11] Patent Number: 5,669,057

[45] Date of Patent: Sep. 16, 1997

[54] REPRODUCTION MACHINE HAVING A TANDEM AUTOMATIC DOCUMENT HANDLER

[75] Inventor: John F. Whiting, Webster, N.Y.

[73] Assignee: Xerox Corporation, Stamford, Conn.

[21] Appl. No.: 538,658

[22] Filed: Oct. 3, 1995

[51] Int. Cl.[6] ..... G03G 15/00

[52] U.S. Cl. ..... 399/369; 399/373

[58] Field of Search ..... 355/308, 309, 355/313, 314, 321; 399/367, 369, 373; 271/9.01, 9.02, 9.04, 9.05, 902

[56] References Cited

U.S. PATENT DOCUMENTS

| | | | |
|---|---|---|---|
| 4,126,390 | 11/1978 | Connin | 355/323 |
| 4,273,439 | 6/1981 | Markham et al. | 355/314 |
| 4,819,023 | 4/1989 | Kitahara | 271/3.1 X |
| 4,834,360 | 5/1989 | Acquaviva | 271/3.1 |
| 5,010,373 | 4/1991 | Linssen et al. | 355/309 X |
| 5,081,699 | 1/1992 | Filion et al. | 395/145 |
| 5,156,386 | 10/1992 | Kitajima et la. | 271/3.1 |
| 5,177,546 | 1/1993 | Tsubo | 355/314 |
| 5,192,976 | 3/1993 | Kitajima et al. | 355/309 |

OTHER PUBLICATIONS

Canon NP-9800 Competitive Bulletin, Accession No. X9200063, Mar. 1992, pp. 1–14.

*Primary Examiner*—William J. Royer
*Attorney, Agent, or Firm*—Tallam I. Nguti

[57] ABSTRACT

A tandem electrostatographic reproduction machine including a Tandem Automatic Document Handler (TADH) for programmed ahead handling of first and second hard copy jobs in tandem. The TADH includes a housing for mounting over a platen of the reproduction machine. The TADH includes a first Recirculating Automatic Document Feeder (RADF) assembly mounted within the housing. The first RADF assembly has a first RADF tray and a first document path for recirculatingly moving sheets of documents seriatim from the first RADF tray over the platen, and back into the first RADF tray. More importantly, the TADH includes a second Recirculating Automatic Document Feeder (RADF) assembly mounted within the housing and in alignment with the first RADF assembly. The second RADF assembly includes a second RADF tray and a second document path for recirculatingly feeding sheets of documents seriatim from the second RADF tray over the platen, and back into the second RADF tray.

14 Claims, 5 Drawing Sheets

REPRODUCTION MACHINE HAVING A TANDEM AUTOMATIC DOCUMENT HANDLER

BACKGROUND OF THE INVENTION

This invention relates to electrostatographic reproduction machines, and more particularly to a tandem reproduction machine having a tandem automatic document handler.

Generally, the process of electrostatographic reproduction includes charging a photoconductive member to a substantially uniform potential so as to sensitize the surface thereof. A charged portion of the photoconductive surface is exposed at an exposure station to a light image of an original document being reproduced. Typically, hard copy jobs, each consisting of a set of sheets of original documents are held and automatically handled by a recirculating document handler to the exposure station. Document handlers used with electrostatographic reproduction machines frequently are provided with a recirculating mode whereby stacked documents are withdrawn individually and sequentially from an input holding tray, passed to the exposure station, and then are outputted back to the holding tray for subsequent recirculation in the previous manner. Some document handlers also invert the documents so that a duplex document may be imaged on both sides.

Exposing a document sheet fed for example by a document handler to the exposure station records an electrostatic latent image onto the photoconductive member. After the electrostatic latent image is recorded as such, the latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred to a copy sheet, on which it is then heated and permanently fused in order to form a "hardcopy" of the original image.

Electrostatographic reproduction machines based on this process are now commonly used in business environments, and frequently in a common or central location where a user or users are often required to sequentially reproduce several multiple-sheet hard copy jobs, one after another. Such sequentially produced jobs currently can be pre-programmed or programmed ahead and batched as disclosed, for example, in the following references.

In U.S. Pat. No. 4,834,360 issued May 30, 1989, to Acquaviva, an automatic job batching system is disclosed for a high capacity copier with an RDH (recirculating document handler). The system includes a separate semi-automatic job loading input device for holding and top-down feeding several jobs through a side automatic document handler entrance. It also includes a separate document stacking tray. The jobs are loaded into the input device with slip sheet indicia for controlling the manner in which the jobs are top-down fed and run by the separate single RDH.

In U.S. Pat. No. 4,126,390 issued Nov. 21, 1978, to Connin, a job batching system is disclosed which is a large and complex system including an overhanging rack for automatically sequentially loading separate document jobs and separate programming cover sheets, therefor, into a single RDH tray.

In U.S. Pat. No. 5,081,699 issued Jan. 14, 1992, to Filion et al., a technique for pre-programming a reproduction machine at a console screen is disclosed for a plurality of complex jobs.

Pre-programming of such jobs for reproduction on a reproduction machine at a common or central location is frequently an inconvenient process. This is because users ordinarily have to remove the first hard copy job from a single or sequential job document handler in order to load and run a second such job, pre-programmed or not. It is often the case that a second person (user or operator) wanting to make copies on a conventional machine, upon seeing a first person at the machine, must either wait or go away and return later when they hope the machine would be idle. Even in the case of a single person desiring to reproduce several such jobs, the person ordinarily must wait for the first job to be completed in order to be able to program, load and run a second job.

Some previous attempts to solve this inconvenience problem are disclosed, for example, in the above cited pre-programming and batching references, and in the following additional references.

In U.S. Pat. No. 4,819,023 issued Apr. 4, 1989, to Kitahara, an automatic document feeder (ADF) is disclosed including a reserved feeding station for automatically feeding a plurality of stacks of originals. The ADF includes a reversible first conveyor for conveying documents without inversion to a processing station. The reserved feeding station includes an inverting mechanism for inverting originals being returned to the reserved feeding station.

In U.S. Pat. No. 5,156,386 issued Oct. 20, 1992, to Kitajima et al., an automatic original document feeder (ADF) is disclosed that includes a first sheet path for inverting and guiding an original from a stacker, a second sheet path branching from the first sheet path in a switchback fashion for guiding the sheet to a process position, and a third sheet path branching from the first sheet path in a switch back fashion for discharging the sheet from the process position after inversion.

Additionally, in 1992 , Canon introduced a machine Canon NP-9800 that apparently utilizes the invention disclosed in U.S. Pat. No. 5,156,386 described above. The NP-9800 incorporates an RDF (recirculating document feeder), and a non-RDF second or subfeeder along with a consecutive job programming mode which can be selected only when the machine is operating. The non-RDF subfeeder is used merely for holding the sheets of the second job while a first job is being run from the RDF. Once the first job is completed, the sheets of the second job are moved into the RDF from the subfeeder before they are then run.

There are several disadvantages with this type of system. First, it does not completely solve the problem or the inconvenience of operators waiting. In order to use the subfeeder, all originals or document sheets in the subfeeder and RDF must be the same size, and must be restricted to letter size sheets, fed long edge first. Overall, the design, programming and operation of the limited, non-RDF and RDF feeders of the Canon NP-9800 clearly appear complex and difficult for walk-up, untrained persons.

There is therefore still a need for a reproduction machine that allows a second hard copy job to be programmed at any time, and to be automatically run, even in a recirculatory mode, once a first hard copy job has been run through the exposure station. Importantly, such a machine should offer, in a second RDF, as complete and independent as possible, a set of features that conventionally are only available in the first RDF.

SUMMARY OF THE INVENTION

In accordance with one aspect of the present invention, there is provided a tandem electrostatographic reproduction machine including a Tandem Automatic Document Handler (TADH) for programmed ahead handling of first and second hard copy jobs in tandem. The TADH includes a housing for mounting over a platen of the reproduction machine. The TADH also includes a first Recirculating Automatic Document Feeder (RADF) assembly mounted within the housing. The first RADF assembly has a first RADF tray and a first document path for recirculatingly moving sheets of documents seriatim from the first RADF tray over the platen, and back into the first RADF tray. More importantly, the TADH includes a second Recirculating Automatic Document Feeder (RADF) assembly mounted within the housing and in alignment with the first RADF assembly. The second RADF assembly includes a second RADF tray and a second document path for recirculatingly feeding sheets of documents seriatim from the second RADF tray over the platen, and back into the second RADF tray.

Pursuant to another aspect of the present invention, there is provided a Tandem Automatic Document Handling (TADH) method of automatically feeding and recirculating multiple document sheets of a first job and of a second job, in tandem, for reproduction in an electrostatographic machine including a controller. The TADH method includes loading multiple document sheets of the first job in a first Recirculating Automatic Document Feeder (RADF) assembly that includes a first RADF tray, and recirculatingly moving the documents sheets of the first job seriatim from the first RADF tray along a first document path through a point for location over a platen of the machine, back into the first RADF tray. The TADH method also includes loading multiple document sheets of the second job in a second Recirculating Automatic Document Feeder (RADF) assembly that includes a second RADF tray, and recirculatingly feeding sheets of documents of the second job seriatim, after recirculatingly moving the documents sheets of the first job, from the second RADF tray along a first portion of a second document path through a point for location over a platen of the machine, and then along a second portion of the second document path located below the first RADF tray, back into the second RADF tray.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
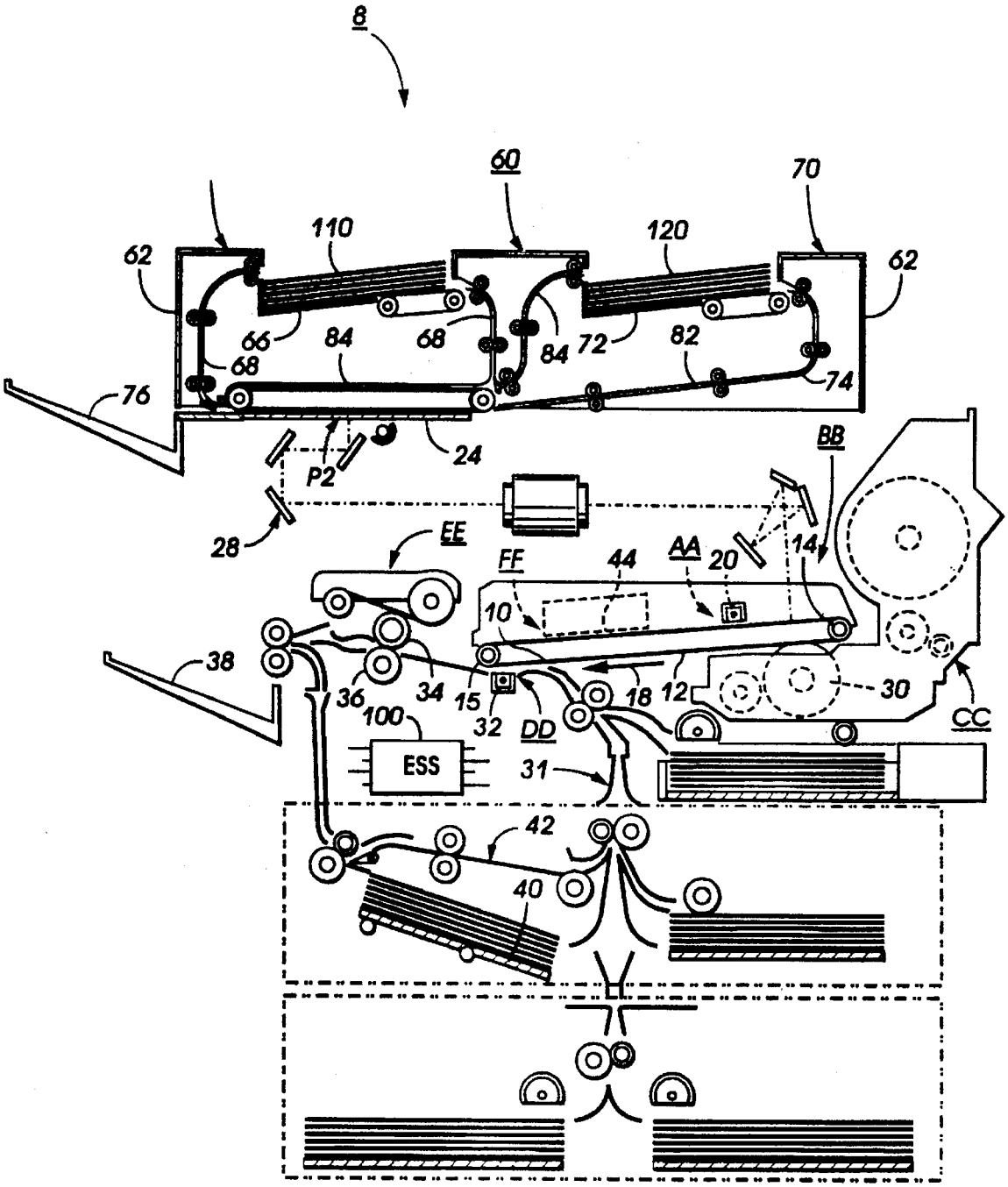
FIG. 1 is a vertical schematic of an exemplary tandem reproduction machine including a tandem automatic document handler (TADH) in accordance with the present invention.

Referring now to FIG. 1, an exemplary tandem reproduction machine 8 according to the present invention is illustrated. As shown, the machine 8 has conventional imaging processing stations associated therewith, including a charging station AA, an imaging/exposing station BB, a development station CC, a transfer station DD, a fusing station EE, and a cleaning station FF. It will be understood that a conventional finishing station (not shown) could easily be included in the machine. The machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10.

The portion of the belt 10 bearing the latent image is then transported to the development station CC where the latent image is developed by electrically charged toner material from a magnetic developer roller 30 of the development station CC. The developed image on the belt is then transported to the transfer station DD where the toner image is transferred to a copy sheet substrate fed by a copy handling system 31. In this case, a corona generating device 32 is provided for charging the copy sheet substrate so as to attract the charged toner image from the photoconductive belt 10 to the copy sheet substrate. The copy sheet substrate with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet substrate. The copy sheet substrate then, as is well known, may be selectively transported to an output tray 38 or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown). The imaging cycle can then be repeated.

Figure 2:
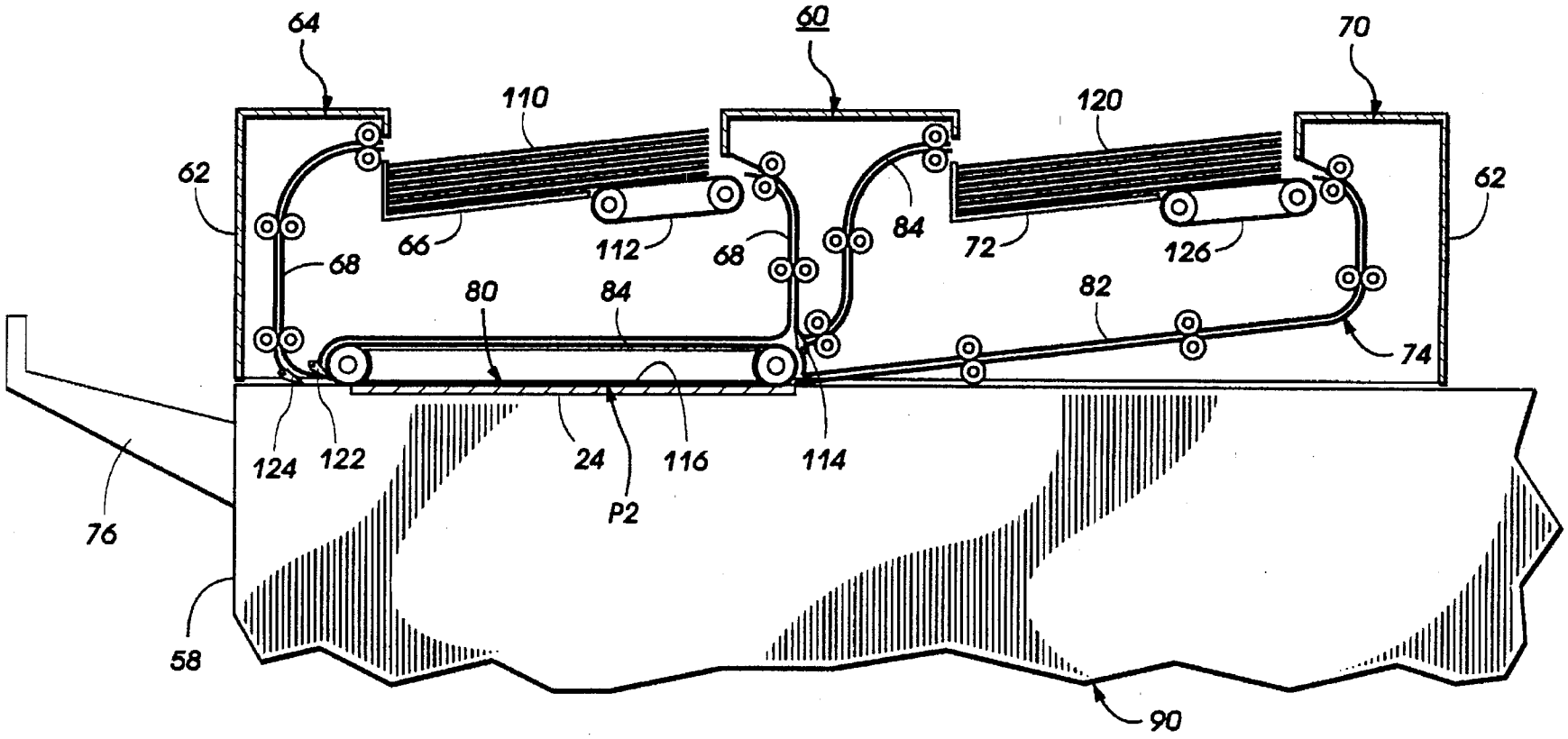
FIG. 2 is a vertical section of the tandem automatic document handler of FIG. 1 shown over the platen portion of the machine of FIG. 1.

The present invention will now be discussed in greater detail with respect to FIGS. 1 to 7. Referring in particular to FIGS. 1 and 2, the tandem machine 8 includes a frame 58 and a Tandem Automatic Document Handler (TADH) 60 according to the present invention. The TADH includes a housing 62 for mounting over the platen 24 of the reproduction machine 8. The TADH 60 also includes a first Recirculating Automatic Document Feeder (RADF) assembly 64 that is mounted within the housing 62. The first RADF assembly 64 includes a first RADF tray 66, and a first document path 68 for recirculatingly moving sheets of documents seriatim from the first RADF tray 66 onto the platen 24, and back into the first RADF tray 66. The TADH further includes a second Recirculating Automatic Document Feeder (RADF) assembly 70 mounted within the housing 62 and in alignment with the first RADF assembly 64. The second RADF assembly 70 includes a second RADF tray 72 and a second document path 74 for recirculatingly feeding sheets of documents seriatim from the second RADF tray 72 onto the platen 24, and back into the second RADF tray 72.

As illustrated, in the Tandem Automatic Document Handler 60, the first document path 68, and the second document path 74 merge at a point P2 where a document sheet being moved along either path can be located for exposure over the platen 24. A catch tray 76 is provided and is mounted relative to one end of the housing 62 in alignment with the first and the second document paths 68, 74 respectively, for receiving document sheets fed from over the platen 24 along either of the first and the second document paths 68, 74.

As further illustrated, the Tandem Automatic Document Handler 60 includes a platen cover member 80, and the second document path 74 includes feed portion 82 for feeding sheets to point P2 over the platen, and a return portion 84 for returning document sheets from the point P2 over the platen into the second RADF tray 72. A good part of the return portion 84 is conveniently located above the platen cover member 80, but below the first RADF tray 66 so as to allow uninterrupted and independent recirculated sheet movement from the point P2 into the second RADF tray 72.

The TADH 60 operates according to a Tandem Automatic Document Handling (TADH) method of the present invention by which multiple document sheets of a first job and of a second job, are automatically fed and recirculated in tandem, for reproduction in a reproducing part 90, of the electrostatographic machine 8. The machine 8 as shown includes a programmable electronic control subsystem or ESS 100 for controlling the functioning of the components and subassemblies of the machine 8 and TADH 60. As will be also understood, the control signals for the document handler operation are provided by controller 100 which is preferably a conventional microprocessor system. It is contemplated that the controller controls all machine steps and functions described herein, as well as that of any and/or all apparatus and devices associated with the document handler.

The tandem method of the present invention includes the step of loading multiple document sheets of a first job 110 (side-being-imaged-up) in the first RADF tray 66 of the first Recirculating Automatic Document Feeder (RADF) assembly 64. The method then includes the step of recirculatingly moving the document sheets of the first job 110, seriatim, from the first RADF tray 66 along the first document path 68. Each sheet being moved as such is inverted, moved through the point P2 over a platen 24 where it can be exposed for imaging, and then back into the first RADF tray 66. As shown, the sheets are fed from the tray 66 for example by a bottom feeder vacuum belt device 112, past a first gating member 114 for pick up and positioning under the platen cover member 80. As is well known, the platen cover member can include a belt 116 for receiving and moving a sheet fed from the first RADF tray 66 into an exposure position over the platen 24. From the position P2 over the platen where the document sheet is exposed or imaged, it is then moved past a second gating member 122, and a third gating member 124, for reinverted return into the tray 66 where the side being imaged is again up. This imaging move from and back to the first tray 66 can therefore be repeated as often as is desired in accordance to preprogrammed instructions for the particular first job.

The method of the present invention importantly also includes the step of loading multiple document sheets of a second job 120 (side-being-imaged-up) in the second RADF tray 72 of the second Recirculating Automatic Document Feeder (RADF) assembly 70. The method next includes the step of recirculatingly feeding sheets of documents of the second job 120, seriatim, (after recirculatingly moving the document sheets of the first job 110), from the second RADF tray 72 along a feed portion 82 of the second document path 74. Each sheet being moved as such is inverted, moved along the feed portion 82 through the point P2 over a platen 24 where it is exposed and imaged, and then back along the return portion 84 of the path 74, into the second RADF tray 72. As shown, the sheets are fed from the tray 72 for example by a bottom feeder vacuum belt device 126, inverted and moved along the feed portion 82 for pick up by, and positioning under, the platen cover member 80 for imaging. From the position P2 over the platen 24, where the document sheet is exposed or imaged, it is then moved past the second gating member 122 (set to block sheet movement along path 68). The sheet is there reinverted and moved along the return portion 84 of path 74 past a reset first gating member 114, for return into the second tray 72 where the side being imaged is again up. This imaging move from and back to the second tray 72 similarly can therefore be repeated as often as is desired in accordance to preprogrammed instructions for the particular second job.

Figure 3:
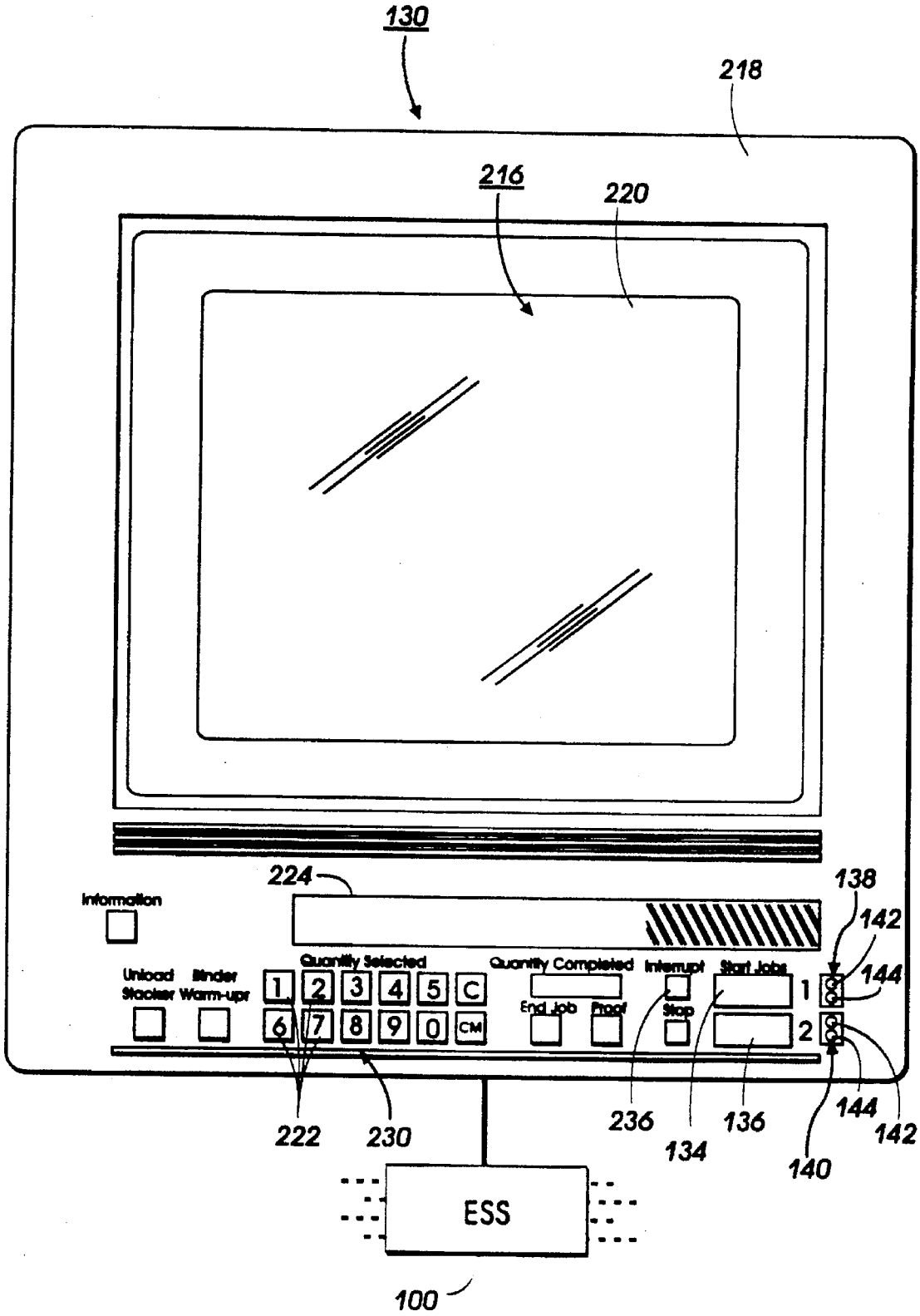
FIG. 3 is a plan view illustration of an operator control panel of the machine of FIG. 1.

Referring now to FIG. 3, pre-programming of the tandem reproduction machine 8 using the electronic control subsystem (ESS) 100 can be accomplished via an operator or user interface (U.I.) 130. The U.I 130 may include a color touch monitor having hard and soft control buttons. The U.I. 130 as such will include a CRT 216 of the type having a peripheral frame 218 and a video screen 220. Soft buttons in the form of icons or pictograms are displayable and usable on the screen 220. Messages can be displayed within a window 224. Hard control buttons 222 are provided, as well as a keypad 230 for programming copy quantities. Other control buttons for example include a job interrupt button 236.

As shown represented by selectable "start buttons 134, 136" respectively, the ESS 100 includes a first programming channel for pre-programming first jobs 110 to be run using the first RADF assembly 64, and a second programming channel for pre-programming second jobs 120 to be run using the second RADF assembly 70. Most importantly, the electronic control subsystem 100 includes means and capability for accepting job programming of an idle one of either channel regardless of whether the other channel is also idle or not idle. Accordingly, the second channel can be preprogrammed while a job is being run at any stage through the first RADF assembly 64. The same is true of preprogramming the first channel while the second channel is busy running a second job through the second RADF assembly 70.

Further in accordance with the present invention, each channel has preferably three states, "OFF", "PROGRAMMED", and "RUNNING". In addition to the start buttons 134, 136, each channel includes a channel selection button 138, 140 respectively. Each channel selection button may include as illustrated a first activatable colored (yellow) LED 142 and a second activatable colored (green) LED 144, where the yellow indicates the "programmed" state, the green the "running" state, and both LEDs off, indicating the "off" state of the respective channels.

In one situation, a single operator with a first job 110 and a second job 120 can preprogram both the first and second channels to reproduce two physically and numerically different jobs by selecting one and then the other of the two channels. The operator can then load the first job in the first RADF assembly 64, and the second job in the second RADF assembly 70. Activation of either start button 134, 136, will cause the one job to be run automatically (in a manner to be described below), after which (or unless interrupted) the other job as programmed is also run automatically (also to be described below).

Figure 4:
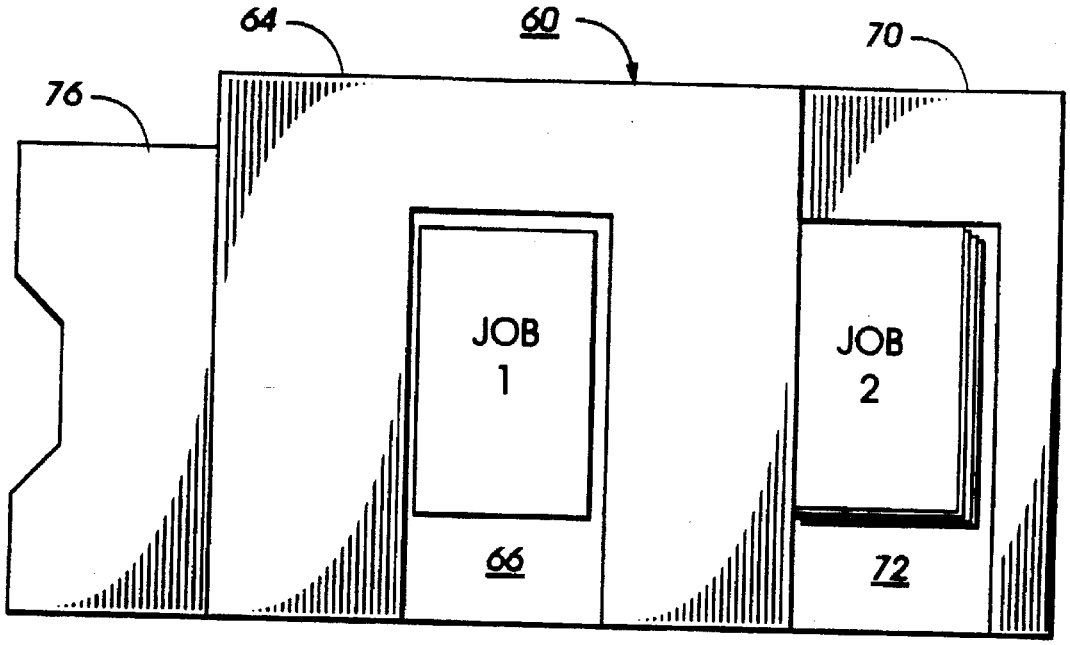
FIG. 4 is a top view illustration of the tandem automatic document handler of FIG. 1 including a first hard copy job and a second hard copy job, each to be run automatically in tandem in accordance with the present invention.
Figure 5:
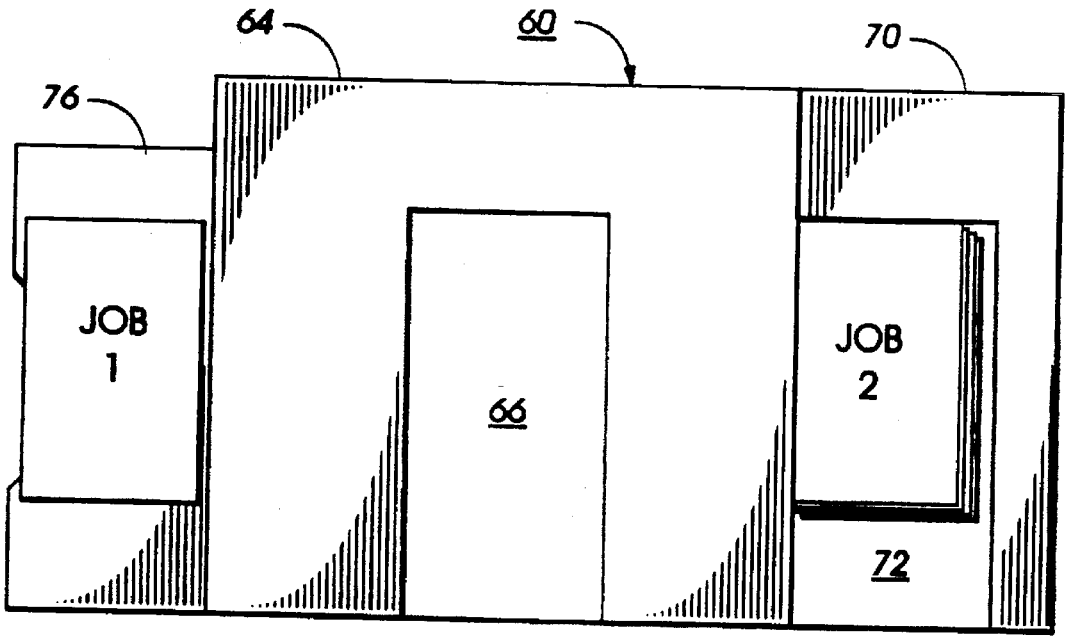
FIG. 5 is a top view illustration of the tandem automatic document handler of FIG. 4 showing completion of the first job in accordance with one option of the present invention.
Figure 6:
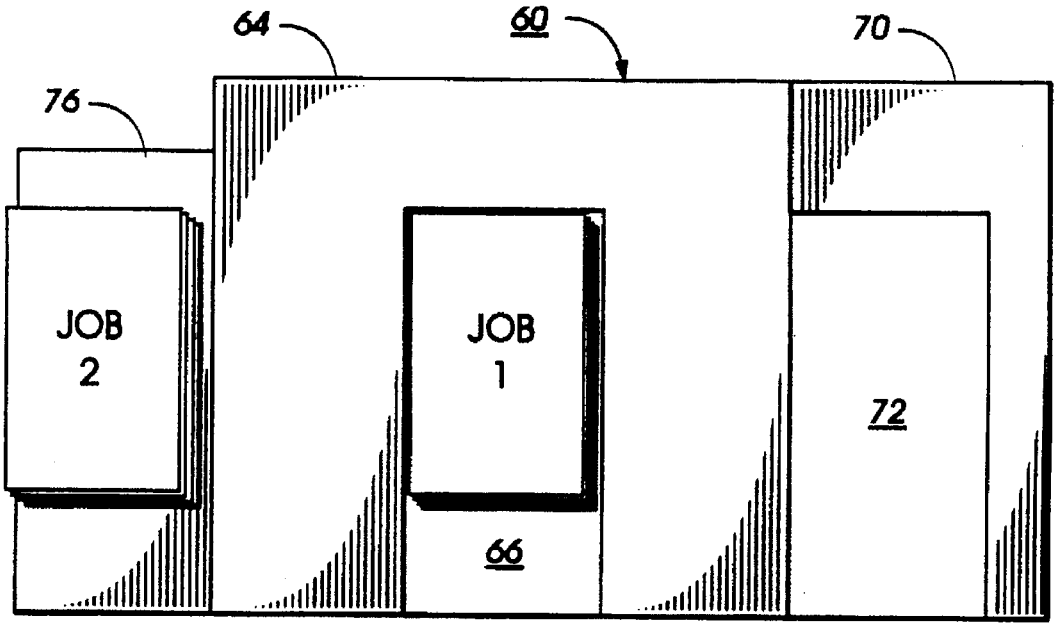
FIG. 6 is a top view illustration of the tandem automatic document handler of FIG. 4 showing completion of the second job in accordance with one option of the present invention.

Referring now to FIGS. 4 to 7, different examples of how the tandem machine 8 of the present invention can be programmed and run will be described. As shown in FIG. 4, job 1, (first job 110) can be loaded into the first RADF tray 66, and run recirculatingly through the first path 68 of the first RADF assembly 60 as many times as are required by a number of desired copies, and returned to the first RADF tray 66. Similarly, (job2), the second job 120 can be loaded into the second RADF tray 72, and run recirculatingly through the second path 74 of the second RADF assembly 70 as many times as are required by a number of desired copies, and returned to the second RADF tray 72. In accordance with the tandem method of the present invention, the first job 110 can be run after the second job 120 and vice versa. As shown in FIG. 5, the first job 110 can be run through the first RADF assembly as above, and the originals instead of being returned to the first RADF tray 66, can be outputted instead to the catch tray 76, thereby freeing the first tray 66 and first RADF 64 for a third job to be programmed as a new first job even while the second RADF tray 72 is tied up with job 2 as shown. Alternatively as shown in FIG. 6, the second job 120 (job 2) instead, after being run as above through the second RADF assembly 70, can be outputted to the catch tray 76, thereby freeing the second RADF tray 72 and assembly 70 for such third job.

The programmable controller 100 thus can be programmed to automatically run the first job 110 and output the first set of document sheets thereof back into the first holding tray 66, or into the side catch tray 76, and to then automatically run, after running the first job 110, the second job 120 and return the second set of document sheets thereof into the second holding tray 72 of the second RADF assembly, or into the catch tray 76.

In accordance with the present invention, the steps of programming and of loading multiple document sheets of the second job 120 into the second RADF tray 72 can occur while, or contemporaneously with that of, recirculatingly moving the documents sheets of the first job 110 through the first RADF assembly 64. Similarly, the steps of programming and of loading multiple document sheets of the first job 110 into the first RADF tray 66 can occur while, or contemporaneously with that of, recirculatingly moving the documents sheets of the second job 120 through the second RADF assembly 72.

Advantageously therefore, a second operator or user who walks up to the machine 8 while it is running a first job through the first RADF assembly, does not have to wait or walk away to come back later. Such an operator or user simply can use the channel selection button to select the second channel, program a job to run through the second RADF assembly 70, load the programmed job into the second RADF tray 72, and then walk away. The programmed job will automatically run as above once the first job has been completed.

Additionally, an advantageous feature of the present invention includes an ability with the first and second RADF assemblies 64, 70 respectively, to use the job interrupt button 236 to interrupt a job running in one of the RADF assemblies (either first or second), and to then use the appropriate start button 134, 136 to recirculatingly run a multiple copies job through the other RADF assembly.

Figure 7:
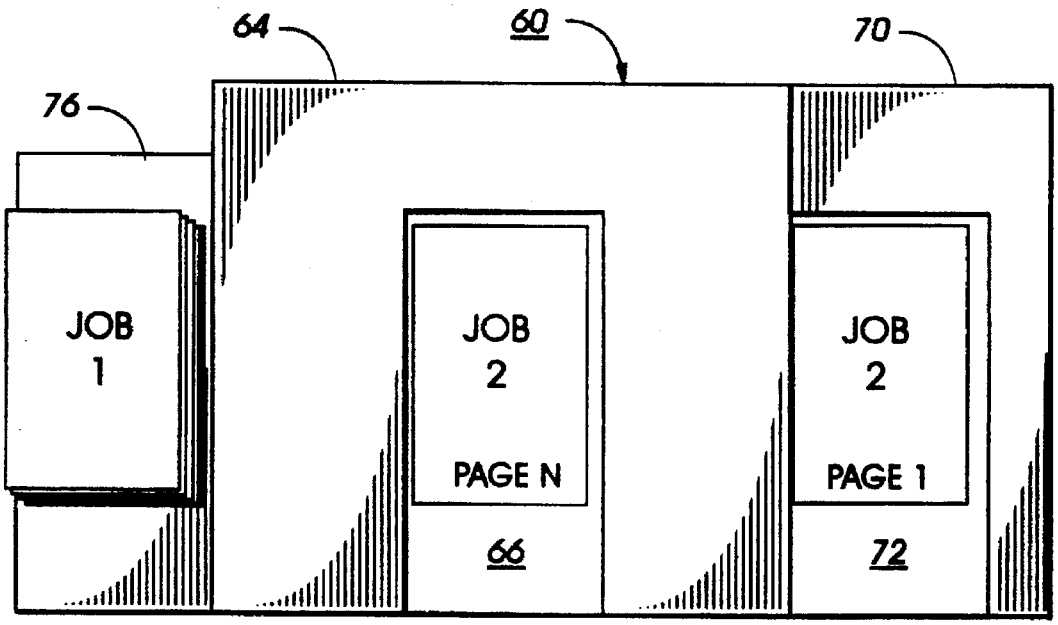
FIG. 7 is a top view illustration of the tandem automatic document handler of FIG. 4 showing in-process one option of running the second job in part through the first RADF assembly in accordance with the present invention

Further, as illustrated in FIG. 7, where the sheet size settings are the same for the first and second RADF trays 66, 72 respectively, a second job 120 requiring a large number of copies, can be run in a first imaging pass from the second tray 72, and then along the first path 68 from the platen position P2 into an empty first tray 66. The job 120 can thereafter be recirculatingly run from tray 66 through the first path 68 as many times as are necessary until the job is completed. The originals of this job can, of course, be outputted either back into the first tray 66, or even back into the second tray 72 via the return portion 84 of the second path 74. These originals can also be outputted to the catch tray 76 if it is empty by the time the job is completed. This approach may be necessary and advantageous because relative to the platen position P2, the first document path 68 is shorter than the second path 74.

In recapitulation, there has been provided a tandem electrostatographic reproduction machine for automatically running multiple hard copy jobs. The machine includes a reproducing unit for reproducing images from each document sheet of a set of hard copy document sheets in a hard copy reproduction job. The reproducing unit includes a hard copy document sheet exposure station. The tandem machine also includes a tandem automatic document handler (TADH) that comprises a first recirculating automatic document sheet feeder (RADF) assembly connected to the reproducing unit for holding and automatically feeding each document sheet of a set of document sheets to the exposure station. The first RADF assembly includes a first holding tray for holding a first hard copy job, and a first recirculating document path. The tandem automatic document handler (TADH) also comprises a second automatic document feeder (RADF) assembly connected to the reproducing unit in alignment with the first RADF assembly for holding and automatically feeding each document sheet of a set of document sheets to the exposure station. The second RADF assembly includes a second document path, and a second holding tray for holding a second hard copy job. A side catch tray is mounted to the machine relative to the exposure station for receiving and holding a set of document sheets fed from the exposure station.

The tandem machine further includes a programmable controller programmed (i) to automatically run the first job and output the first set of document sheets thereof into the first RADF tray or into the side catch tray, and (ii) to automatically run, after running the first job, the second job and return the second set of document sheets thereof into the second holding tray of the second RADF assembly, or output them to the catch tray, or even into the first RADF tray depending on which is empty.

It is, therefore, apparent that there has been provided in accordance with the present invention, a tandem reproduction machine including a tandem automatic document handier that fully satisfy the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A Tandem Automatic Document Handler (TADH) for use in an electrostatographic reproduction machine, the TADH comprising:

(a) a housing for mounting over a platen of the reproduction machine;

(b) a first Recirculating Automatic Document Feeder (RADF) assembly mounted within said housing, said first RADF assembly including a first RADF tray and a first document path for recirculatingly moving sheets of documents seriatim from said first RADF tray onto the platen, and back into said first RADF tray;

(c) a second Recirculating Automatic Document Feeder (RADF) assembly mounted within said housing and in alignment with said first RADF assembly, said second RADF assembly including a second RADF tray and a second document path for recirculatingly feeding sheets of documents seriatim from said second RADF tray onto the platen, and back into said second RADF tray; and (d) an electronic control subsystem connected to said first RADF and said second RADF and having a control panel, a first programming channel, a second programmable channel, and means for programming a second job in one of said first and said second RADH even while a first job is still being run in another of said first and said second RADH.

2. The Tandem Automatic Document Handler of claim 1 including a catch tray mounted relative to one end of said housing in alignment with said first and said second document paths for receiving document sheets fed from over the platen along either of said first and said second document paths.

3. The Tandem Automatic Document Handler of claim 1, wherein said first document path and said second document path merge at a point for locating a document sheet over a platen of a reproduction machine.

4. The Tandem Automatic Document Handler of claim 1, including a platen cover member, and wherein said second document path includes a return portion for returning document sheets into said second RADF tray, said return portion being located above said platen cover member and below said first RADF tray.

5. A Tandem Automatic Document Handling (TADH) method of automatically feeding and recirculating multiple document sheets of a first job and of a second job, in tandem, for reproduction in an electrostatographic machine including a controller, the TADH method comprising:

(a) loading multiple document sheets of the first job into a first Recirculating Automatic Document Feeder (RADF) tray of a first RADF assembly;

(b) programming the first job in a first channel of the controller and recirculatingly moving the documents sheets of the first job seriatim from said first RADF tray along a first document path through a point for location over a platen of the machine and back into said first RADF tray;

(c) loading multiple document sheets of the second job into a second Recirculating Automatic Document Feeder (RADF) tray of a second RADF assembly even while still recirculatingly moving the document sheets of the first job;

(d) programming the second job in a second channel of the controller even while still recirculatingly moving the document sheets of the first job; and recirculatingly feeding sheets of documents of the second job seriatim, after recirculatingly moving the documents sheets of the first job, from said second RADF tray along a first portion of a second document path through a point for location over a platen of the machine, and then along a second portion of the second document path located below the first RADF tray, back into said second RADF tray.

6. The method of claim 5 wherein said steps of recirculatingly moving the document sheets of the first job and of loading multiple document sheets of the second job can occur contemporaneously.

7. The method of claim 5 wherein said steps of recirculatingly moving the documents sheets of the second job and of loading multiple document sheets of the first job can occur contemporaneously.

8. A tandem method of automatically handling multiple document sheets of a first job and multiple document sheets of a second job through a document sheet position over a platen of an electrostatographic reproduction machine including a programmable controller, the method comprising the steps of:

(a) programming the first job in a first channel of the controller and loading document sheets of the first job in a first recirculating automatic document feeding (RADF) tray of a tandem automatic document handler (TADH) mounted over the platen;

(b) programming the second job in a second channel of the controller and loading document sheets of the second job, contemporaneously with the first job, in a second recirculating automatic document feeding (RADF) tray of the TADH;

(c) automatically feeding the document sheets of the first job from the first RADF tray along a first document path through the document sheet position over the platen and into a catch tray to complete the first job; and (d) automatically feeding, after completion of the first job, the document sheets of the second job from the second RADF tray along a second document path through the document sheet position over the platen and back into the second RADF tray to complete the second job.

9. The tandem method of claim 8, wherein said step of programming and loading the second job comprises loading multiple sheets of the second job into the second RADF tray while feeding document sheets of the first job from the first RADF tray through the first document path.

10. The tandem method of claim 8, wherein said step of automatically feeding document sheets of the first job includes a step of recirculating each of the document sheets of the first job a plural number of times as desired from the first RADF tray through the document sheet position over the platen for making multiple reproductions of each such document sheet, prior to being fed into the catch tray.

11. The tandem method of claim 8, wherein said step of automatically feeding the document sheets of the second job from the second RADF tray includes a step of recirculating each of the document sheets of the second job from the second RADF tray a plural number of times as desired through the document sheet position over the platen for making multiple reproductions of each such document sheet.

12. Reproduction machine comprising:

(a) a platen for positioning a document sheet to be reproduced;

(b) a movable image bearing member mounted to a frame of the reproduction machine below said platen, said image bearing member having a photoconductive surface;

(c) means for placing a layer of charge on said photoconductive surface;

(d) means for exposing a document positioned on said platen onto a portion of said photoconductive surface;

(e) a tandem automatic document handler (TADH) mounted over said platen, said TADH including:

(i) a housing;

(ii) a first recirculating automatic document feeder (RADF) assembly mounted within said housing, said first RADF assembly including a first RADF tray for holding document sheets of a first job, and means for automatically feeding document sheets of the first job from said first RADF tray through a position over said platen; and (iii) a second recirculating automatic document feeder (RADF) assembly mounted within said housing in alignment with said first RADF assembly, said second RADF assembly including a second RADF tray for holding document sheets of a second job while said first RADF assembly is still feeding document sheets of the first job; and (f) an electronic control subsystem having a control panel, a first programming channel, a second programming channel, and means for programming a second job while a first job is still being run.

13. The tandem reproduction machine of claim 12, including a catch tray mounted relative to one end of said TADH for receiving document sheets from said position over said platen.

14. The reproduction machine of claim 12, wherein said control panel includes a first channel selection button having first and second colored light sources for indicating various states of said first programming channel, and a second channel selection button having first and second colored light sources for indicating various states of said second programming channel.

* * * * *